US009316383B2

(12) United States Patent
Ter Weeme et al.

(10) Patent No.: US 9,316,383 B2
(45) Date of Patent: Apr. 19, 2016

(54) LED LIGHTING DEVICE WITH TEMPERATURE DEPENDENT OUTPUT STABILIZER

(75) Inventors: Berend Jan Willem Ter Weeme, Eindhoven (NL); William Peter Mechtildis Marie Jans, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 758 days.

(21) Appl. No.: 13/582,809

(22) PCT Filed: Mar. 3, 2011

(86) PCT No.: PCT/IB2011/050897

§ 371 (c)(1), (2), (4) Date: Nov. 15, 2012

(87) PCT Pub. No.: WO2011/110981

PCT Pub. Date: Sep. 15, 2011

(65) Prior Publication Data

US 2013/0201677 A1 Aug. 8, 2013

(30) Foreign Application Priority Data

Mar. 10, 2010 (EP) ..... 10156099

(51) Int. Cl.

| | |
|---|---|
| ***F21V 23/02*** | (2006.01) |
| ***H05B 37/02*** | (2006.01) |
| ***F21V 21/00*** | (2006.01) |
| ***H05B 33/08*** | (2006.01) |

(52) U.S. Cl.

CPC ..... *F21V 21/00* (2013.01); *H05B 33/08* (2013.01); *H05B 33/0821* (2013.01); *H05B 33/0857* (2013.01); *Y10T 29/49117* (2015.01)

(58) Field of Classification Search

CPC ..... F21K 9/00; F21V 23/003; F21V 23/00; H01L 23/647; H05B 37/00; H05B 37/02; H05B 41/39

See application file for complete search history.

(56) References Cited

U.S. PATENT DOCUMENTS

| | | | |
|---|---|---|---|
| 2004/0105264 | A1 | 6/2004 | Spero |
| 2007/0171159 | A1 | 7/2007 | Lee |

FOREIGN PATENT DOCUMENTS

| | | | |
|---|---|---|---|
| JP | 2000260582 | A | 9/2000 |
| JP | 2007201473 | A | 8/2007 |
| JP | 2009076684 | A | 9/2009 |
| JP | 201044399 | A | 2/2010 |
| WO | 2004047498 | A1 | 6/2004 |
| WO | 2010054650 | A1 | 5/2010 |

*Primary Examiner* — Ismael Negron

(57) ABSTRACT

A lighting device has a plurality of LEDs of at least two types connected in series. At least one of the LEDs of the first type and LEDs of the second type is connected in parallel to a resistor assembly, such that the temperature-dependent resistance of the resistor assembly stabilizes a ratio of luminous flux output at different junction temperatures of the LEDs.

13 Claims, 4 Drawing Sheets

LED LIGHTING DEVICE WITH TEMPERATURE DEPENDENT OUTPUT STABILIZER

FIELD OF THE INVENTION

The invention relates to the field of light emitting diode, LED, lighting, and more specifically to a LED lighting device comprising different LED types, and having a circuit arrangement for maintaining color consistency at different junction operating temperatures.

BACKGROUND OF THE INVENTION

In a LED lighting device, a plurality of LEDs may be applied. In a LED lighting device which is either designed for switching on and off, or designed for dimming applications, LEDs of different types may be combined to obtain a light output having a predetermined color at steady state operating conditions. As an example, when combining InGaN type LEDs with AlInGaP type LEDs, an efficient LED lighting device in a low correlated color temperature, CCT, range (2,500-3,000 K) can be made.

It is known that the luminous flux output, also referred to as light flux output, light output, or lumen output, of a LED changes as a function of its junction temperature. When the junction temperature increases, the luminous flux output decreases. The phenomenon will be referred to as luminous flux output degradation.

When using different LED types in a lighting device, a problem arises when the LEDs of one type show different luminous flux output degradation as a function of their junction temperature than LEDs of another type. Different luminous flux output degradations may result in different proportions of luminous flux output from the different LED types in the total light output of the LED lighting device, and consequently, when the LEDs of different type emit light of different color, this may lead to the lighting device emitting a different color of light at different junction temperatures of the LEDs. This is undesirable.

Solutions to this problem usually propose a feedback loop with a temperature sensor and a micro-processor to control an electric quantity of the power supply to at least one or some of the LEDs to maintain the color of the light output by the lighting device within a predetermined range by keeping the ratio of the luminous flux output from the different types of LEDs substantially constant at different junction temperatures, as measured by the temperature sensor.

SUMMARY OF THE INVENTION

It would be desirable to provide an LED lighting device having LEDs of different types, and a method of producing thereof, in which device the ratio of the luminous flux output from the different types of LEDs may be kept substantially constant at different junction temperatures using a simple circuit arrangement.

To better address this concern, in a first aspect of the invention, a lighting device comprising a plurality of LEDs is provided, the lighting device comprising: a first LED assembly comprising at least one LED of a first type having a varying first luminous flux output as a function of its junction temperature; a second LED assembly comprising at least one LED of a second type having a varying second luminous flux output as a function of its junction temperature different from the first luminous flux output of the first LED assembly as a function of its junction temperature, wherein the first LED assembly is connected in series to the second LED assembly, and wherein at least one of the LEDs of the first type and LEDs of the second type is connected in parallel to a resistor assembly having a temperature-dependent resistance, the temperature dependence of the resistance being adapted to stabilize, within a predetermined range, a ratio of the first luminous flux output to the second luminous flux output at different junction temperatures of the first LED assembly and the second LED assembly.

In a second aspect of the invention, a method of producing a lighting device comprising a plurality of LEDs is provided, the method comprising: providing a first LED assembly comprising at least one LED of a first type having a varying first luminous flux output as a function of its junction temperature; providing a second LED assembly comprising at least one LED of a second type having a varying second luminous flux output as a function of its junction temperature different from the first luminous flux output of the first LED assembly as a function of its junction temperature; connecting the first LED assembly in series to the second LED assembly; connecting at least one of the LEDs of the first type and the LEDs of the second type in parallel to a resistor assembly having a temperature-dependent resistance; and adapting the temperature dependence of the resistance to stabilize, within a predetermined range, a ratio of the first luminous flux output to the second luminous flux output at different junction temperatures of the first LED assembly and the second LED assembly.

The invention provides a relatively simple and cheap lighting device which can be powered by a constant current source without use of any feedback control to produce light of a constant color at varying LED junction temperatures.

Within the scope of the invention, a resistor assembly may be connected in parallel to one first LED of a first type, possibly with other LEDs of the first type connected in series to the first LED of the first type not having a resistor assembly connected in parallel thereto. A resistor assembly may also be connected in parallel to multiple series-connected LEDs of the first type, possibly with other LEDs of the first type connected in series to said multiple series-connected LEDs of the first type not having a resistor assembly connected in parallel thereto. Also, combinations of the previous arrangements may be made. Alternatively, each one of a plurality of series-connected LEDs of the first type may have its own resistor assembly connected in parallel thereto.

The variety of circuit arrangements including one or more resistor assemblies described above for one or more series-connected LEDs of the first type, are also possible for one or more series-connected LEDs of the second type. Also, a combination of the variety of circuit arrangements including one or more resistor assemblies for one or more series-connected LEDs of the first type and one or more resistor assemblies for one or more series-connected LEDs of the second type may be made.

A resistor assembly has a temperature-dependent resistance which is designed to compensate, inter alia, a difference between luminous flux output/junction temperature characteristics of a LED of the first type and a LED of the second type. In practice, a resistor assembly may comprise a single resistor or a plurality of resistors, connected in series, in parallel or partly in series and partly in parallel to one another to achieve a suitable temperature-dependent resistance characteristic.

In an embodiment, when the first luminous flux output decreases with increasing junction temperature of the first LED assembly at a first rate, and the second luminous flux output decreases with increasing junction temperature of the second LED assembly at a second rate lower than the first rate, a first resistor assembly may be connected in parallel to at least one LED of the first LED assembly, with the resistance of the first resistor assembly increasing with increasing temperature of the first resistor assembly (positive temperature coefficient, PTC, behavior of the first resistor assembly, wherein the temperature coefficient may or may not be constant over the relevant temperature range). At a nominal operating temperature of the first and second LED assemblies (at nominal current), the ratio of the luminous flux outputs of the first and second LED assemblies provides a predetermined color of the light emitted by the lighting device. At temperatures lower than the nominal operating temperature of the first and second LED assemblies, and without correction, the proportion of the light emitted by the first LED assembly increases relative to the proportion of the light emitted by the second LED assembly. Thus, at such temperatures lower than the nominal operating temperature, the current through the first LED assembly may be decreased to lower the proportion of the light emitted by the first LED assembly, in order to keep the luminous flux ratio of the first and second LED assemblies constant, or at least within a certain range, or to keep the color of the light emitted by the lighting device within a certain range (e.g. such that the color shift is less than a predetermined number of standard deviation of color matching, SDCM, steps, e.g. 7, which is acceptable to the human eye). The first resistor assembly, having a positive temperature coefficient behavior, corrects this by having a lower resistance and thus drawing more current at lower temperatures which leads to a desired decrease of current through the first LED assembly at lower temperatures. Accordingly, the color of the light emitted by the lighting device can be kept essentially the same at different temperatures.

Instead of the first resistor assembly, or in combination with the first resistor assembly, a second resistor assembly may be connected in parallel to at least one LED of the second LED assembly, with the resistance of the second resistor assembly decreasing with increasing temperature of the second resistor assembly (negative temperature coefficient, NTC, behavior of the second resistor assembly, wherein the temperature coefficient may or may not be constant over the relevant temperature range). At temperatures lower than the nominal operating temperature of the first and second LED assemblies, without correction, the proportion of the light emitted by the first LED assembly increases relative to the proportion of the light emitted by the second LED assembly. Thus, at such temperatures lower than the nominal operating temperature, the current through the second LED assembly may be increased to increase the proportion of the light emitted by the second LED assembly, in order to keep the luminous flux ratio of the first and second LED assemblies constant, or at least within a certain range, or to keep the color of the light emitted by the lighting device within a certain range (e.g. such that the color shift is less than a predetermined number of SDCM steps, e.g. 7, which is acceptable to the human eye). The second resistor assembly, having a negative temperature coefficient behavior, corrects this by having a higher resistance and thus drawing less current at lower temperatures which leads to the desired increase of current through the second LED assembly.

In a combination of applying a first resistor assembly with positive temperature coefficient behavior, and a second resistor assembly with negative temperature coefficient behavior, the corrective influence of both the first and the second resistor assemblies on the luminous flux outputs of their respective corresponding first and second LED assemblies may be less than in the case where one of the first resistor assembly and the second resistor assembly would be absent.

In a third aspect of the present invention, a lighting kit of parts is provided, comprising: a dimmer having input terminals adapted to be connected to an electrical power supply, the dimmer having output terminals adapted to provide a variable current; and a LED lighting device according to the first aspect of the invention, the lighting device having terminals configured to be connected to the output terminals of the dimmer.

These and other aspects of the invention will be more readily appreciated as the same becomes better understood by reference to the following detailed description and considered in connection with the accompanying drawings in which like reference symbols designate like parts.

DETAILED DESCRIPTION OF EMBODIMENTS

For a LED, a luminous flux output FO variation may be characterized by a so-called hot-coldfactor, indicating a percentage of luminous flux loss from 25° C. to 100° C. junction temperature of the LED. This is illustrated by reference to FIGS. 1 and 2.

Figure 1:
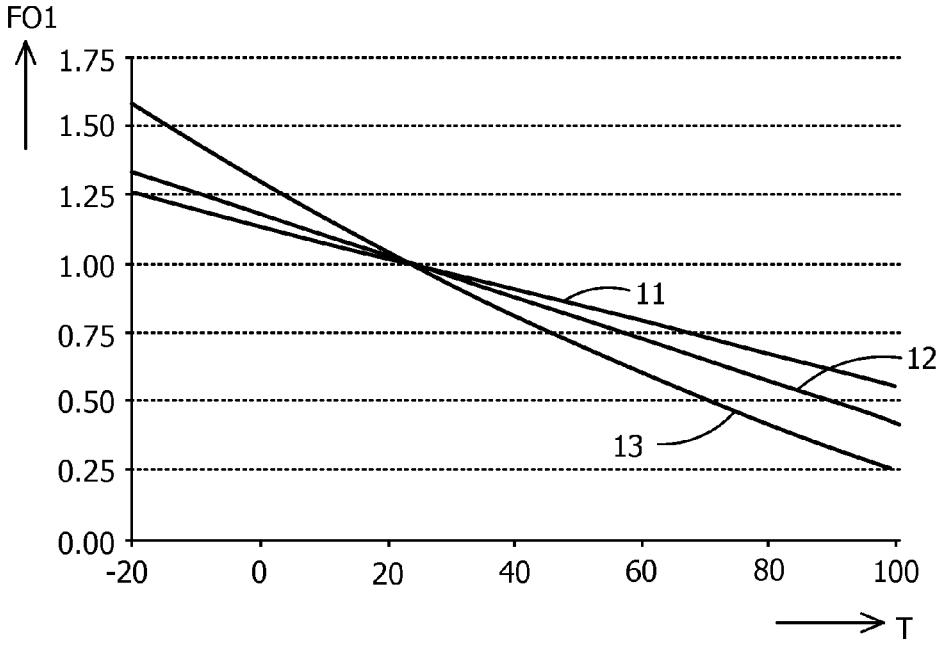
FIG. 1 depicts graphs of a relationship between a normalized luminous flux output (vertical axis, lumen/milliwatt) and junction temperature (horizontal axis, ° C.) for different LEDs of a first type.

FIG. 1 depicts graphs of a luminous flux output FO1 at varying junction temperatures T, of different LEDs of a first type, e.g. AlInGaP type LEDs. A first graph 11 illustrates a luminous flux output FO1 decrease at a junction temperature T increase for a red photometric LED. A second graph 12 illustrates a steeper luminous flux output FO1 decrease than the graph 21 at a junction temperature T increase for a red-orange photometric LED. A third graph 13 illustrates a still steeper luminous flux output FO1 decrease than the graphs 11 and 12 at a junction temperature T increase for an amber photometric LED.

Figure 2:
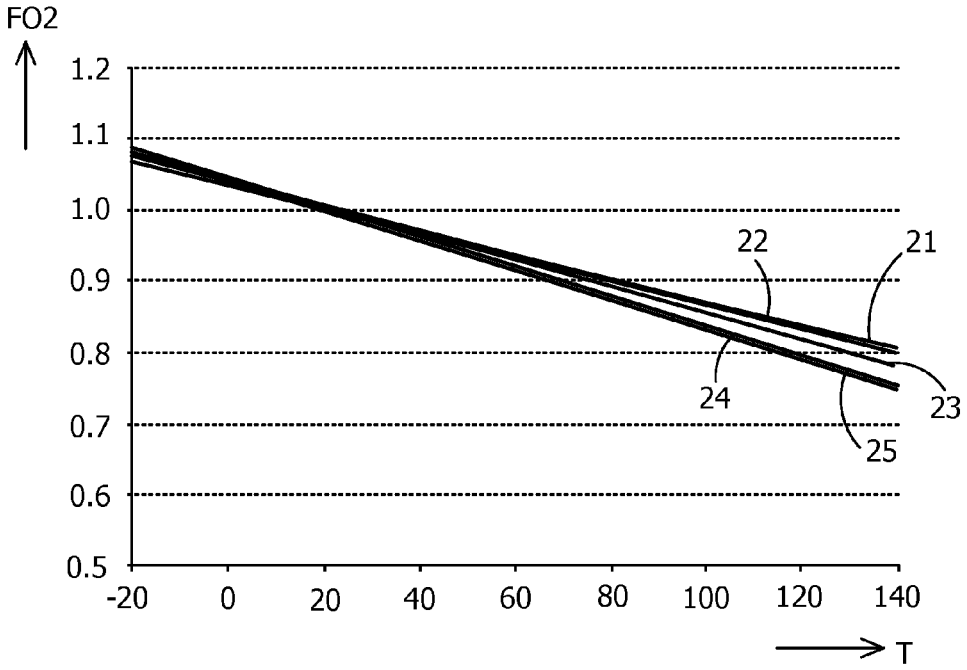
FIG. 2 depicts graphs of a relationship between a normalized luminous flux output (vertical axis, lumen/milliwatt) and junction temperature (horizontal axis, ° C.) for different LEDs of a second type.

FIG. 2 illustrates graphs of a luminous flux output FO2 at varying junction temperatures T, of different LEDs of a second type, e.g. InGaN type LEDs. A first graph 21 illustrates a luminous flux output FO2 decrease at a junction temperature T increase for a cyan photometric LED. A second graph 22 illustrates a slightly steeper luminous flux output FO2 decrease than the graph 21 at a temperature T increase for a green photometric LED. A third graph 23 illustrates a still steeper luminous flux output FO2 decrease than the graphs 21 and 22 at a temperature T increase for a royal-blue radiometric LED. A fourth graph 24 illustrates a yet steeper luminous flux output FO2 decrease than the graphs 21, 22 or 23 at a temperature T increase for a white photometric LED. A fifth graph 25 illustrates a still slightly steeper luminous flux output FO2 decrease than the graphs 21, 22, 23 or 24 at a temperature T increase for a blue photometric LED.

FIGS. 1 and 2 show that an LED of a first type has a higher hot-coldfactor than an LED of a second type, indicating that the gradient of the luminous flux output as a function of temperature of the LED of the first type is higher than the gradient of the luminous flux output as a function of temperature of the LED of the second type.

It is assumed that LEDs of a first type as illustrated in FIG. 1, and LEDs of a second type as illustrated in FIG. 2 are used to create a lighting device having a series connection of a first LED assembly having series connected LEDs of the first type, and a second LED assembly having series connected LEDs of the second type. Further, as an example it is assumed that the combination of the first LED assembly and the second LED assembly is designed such that at a maximum junction temperature of 100° C. the current through the LEDs of the first type and the LEDs of the second type is essentially equal. It is noted that other designs may lead to other maximum junction temperatures.

Figure 3:
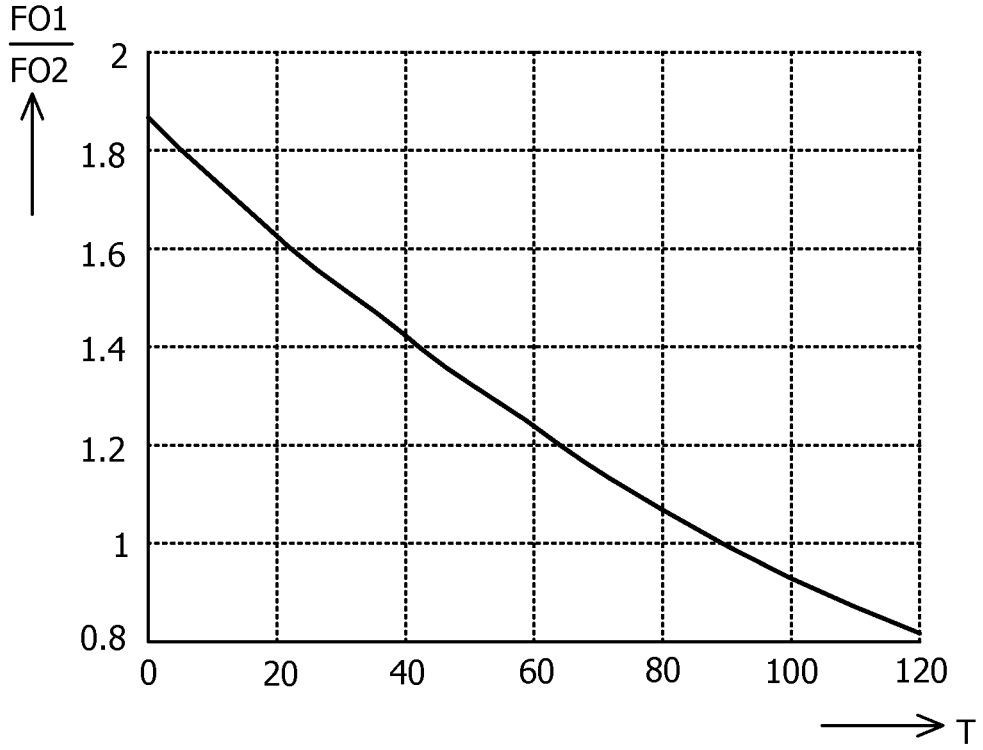
FIG. 3 depicts a graph of a relationship between a relative luminous flux ratio deviation (vertical axis, dimensionless) and junction temperature (horizontal axis, ° C.) in a lighting device comprising LEDs of the first type and LEDs of the second type, without corrective measures in accordance with the present invention.

From FIG. 1 it follows that at 100° C., an LED of the first type produces approximately 50% of its luminous flux at 20° C. (room temperature). From FIG. 2 it follows that at 100° C., an LED of the second type produces approximately 85% of its luminous flux at room temperature. Assuming a linear relationship between current and luminous flux for each LED type, it follows that in order to keep a luminous flux ratio of the lighting device approximately the same at 20° C. and at 100° C., the current through the second LED assembly should be decreased by a factor of approximately 0.5/0.85 at room temperature, or the current through the first LED assembly should be increased by a factor of approximately 0.85/0.5 at room temperature. For other junction temperatures, other correction factors apply, as can be derived from FIG. 3, showing relative luminous flux ratio deviations FO1/FO2 at different junction temperatures T.

As illustrated in FIGS. 4*a*, 4*b*, 4*c*, and 4*d*, a constant or variable current source 40, which may include a dimmer, and generating a current I, has its (two) output terminals connected to (two) input terminals 41*a*, 41*b* of a LED lighting device 42*a-d* generally indicated with a dashed line. For dimming purposes, the current source 40 may be pulse width modulated. The junction temperature of an LED will decrease when dimming.

Figure 4A:
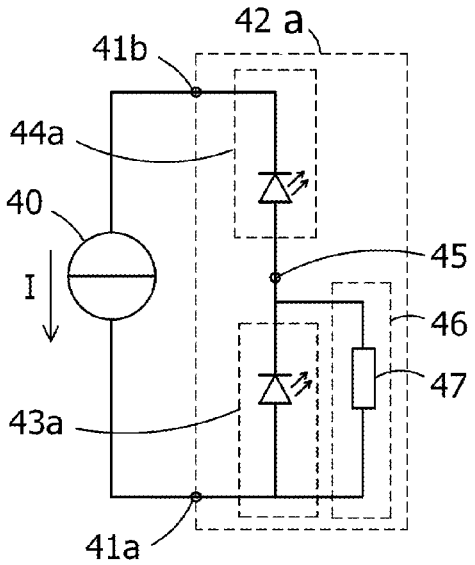
FIGS. 4*a*, 4*b*, 4*c*, and 4*d* depict circuit diagrams of different embodiments of a LED lighting device according to the present invention, where the embodiment of FIG. 1*a* is connected to a current source.

Referring to FIG. 4*a*, the lighting device 42*a* comprises a first LED assembly 43*a*, indicated by dashed line, and a second LED assembly 44*a*, indicated by a dashed line, connected in series to the first LED assembly 43*a* through a node 45 connecting a cathode of the first LED assembly 43*a* with an anode of the second LED assembly 44*a*. The series connection of the first LED assembly 43*a* and the second LED assembly 44*a* is connected between the input terminals 41*a*, 41*b* of the LED lighting device 44*a*. Each of the first LED assembly 43*a* and the second LED assembly 44*a* comprises a single LED, wherein the LED of the first LED assembly 43*a* is of a first type, and the LED of the second LED assembly 44*a* is of a second type. The LED of the first type has a varying first luminous flux output as a function of its junction temperature, whereas the LED of the second type has a varying second luminous flux output as a function of its junction temperature, which function is different from the first luminous flux output of the LED of the first type as a function of its junction temperature.

The LED of the first type is connected in parallel to a resistor assembly 46 generally indicated with a dashed line. Thus, the resistor assembly 46, which in an embodiment may comprise a single resistor 47, but may also comprise multiple resistors (a resistor network), is connected between input terminal 41*a* and node 45.

Figure 4B:
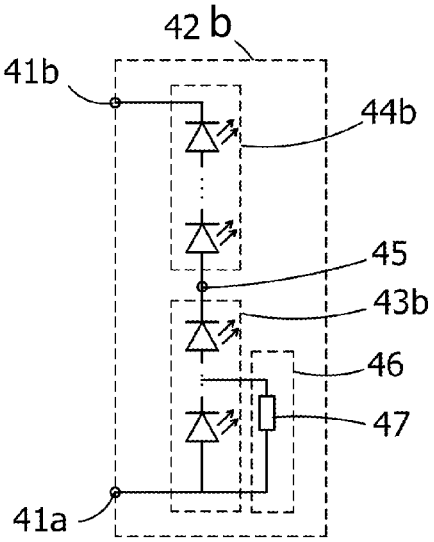

Referring to FIG. 4*b*, the lighting device 42*b* comprises a first LED assembly 43*b*, indicated by dashed line, and a second LED assembly 44*b*, indicated by a dashed line, connected in series to the first LED assembly 43*b* through a node 45 connecting a cathode of the first LED assembly 43*b* with an anode of the second LED assembly 44*b*. The series connection of the first LED assembly 43*b* and the second LED assembly 44*b* is connected between the input terminals 41*a*, 41*b* of the LED lighting device 42*b*. Each, or at least one of the first LED assembly 43*b* and the second LED assembly 44*b* comprises more than one LED connected in series to one another to form a string of LEDs, wherein the LEDs of the first LED assembly 43*b* are of a first type, and the LEDs of the second LED assembly 44*b* are of a second type. The LED of the first type has a varying first luminous flux output as a function of its junction temperature, whereas the LED of the second type has a varying second luminous flux output as a function of its junction temperature, which function is different from the first luminous flux output of the LED of the first type as a function of its junction temperature.

At least one of the LEDs of the first type is connected in parallel to a resistor assembly 46 generally indicated with a dashed line. Thus, the resistor assembly 46, which in an embodiment may comprise a single resistor 47, but may also comprise multiple resistors (a resistor network), is connected between, on the one hand, input terminal 41*a* and, on the other hand, a node between two subsequent LEDs of the string of LEDs of the first type. Alternatively, the resistor assembly 46 may be connected between, on the one hand, node 45 and, on the other hand, a node between two subsequent LEDs of the string of LEDs of the first type. As a further alternative, the resistor assembly 46 may be connected between, on the one hand, a node between two subsequent LEDs of the string of LEDs of the first type and, on the other hand, another node between two subsequent LEDs of the string of LEDs of the first type.

Figure 4C:
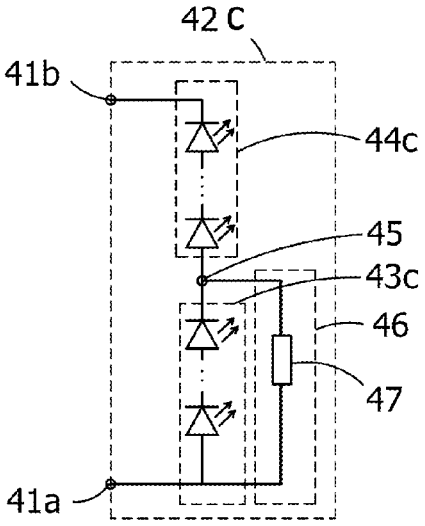

Referring to FIG. 4*c*, the lighting device 42*c* comprises a first LED assembly 43*c*, indicated by dashed line, and a second LED assembly 44*c*, indicated by a dashed line, connected in series to the first LED assembly 43*c* through a node 45 connecting a cathode of the first LED assembly 43*c* with an anode of the second LED assembly 44*c*. The series connection of the first LED assembly 43*c* and the second LED assembly 44*c* is connected between the input terminals 41*a*, 41*b* of the LED lighting device 42*c*. Each, or at least one of the first LED assembly 43*c* and the second LED assembly 44*c* comprises more than one LED connected in series to one another to form a string of LEDs, wherein the LEDs of the first LED assembly 43*c* are of a first type, and the LEDs of the second LED assembly 44*c* are of a second type. The LED of the first type has a varying first luminous flux output as a function of its junction temperature, whereas the LED of the second type has a varying second luminous flux output as a function of its junction temperature, which function is different from the first luminous flux output of the LED of the first type as a function of its junction temperature.

At least one of the LEDs of the first type is connected in parallel to a resistor assembly 46 generally indicated with a dashed line. Thus, the resistor assembly 46, which in an embodiment may comprise a single resistor 47, but may also comprise multiple resistors (a resistor network), is connected between input terminal 41*a* and node 45.

Figure 4D:
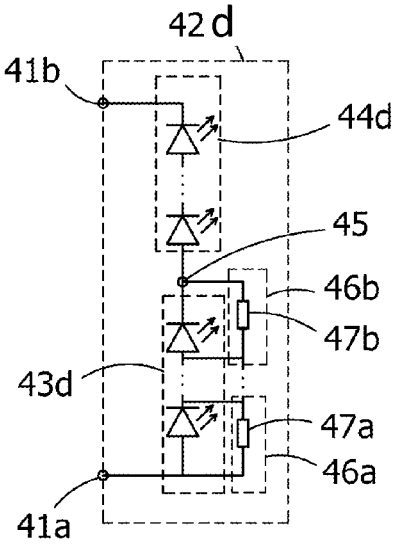

Referring to FIG. 4*d*, the lighting device 42*d* comprises a first LED assembly 43*d*, indicated by dashed line, and a second LED assembly 44*d*, indicated by a dashed line, connected in series to the first LED assembly 43*d* through a node 45 connecting a cathode of the first LED assembly 43*d* with an anode of the second LED assembly 44*d*. The series connection of the first LED assembly 43*d* and the second LED assembly 44*d* is connected between the input terminals 41*a*, 41*b* of the LED lighting device 42*d*. Each, or at least one of the first LED assembly 43*d* and the second LED assembly 44*d* comprises more than one LED connected in series to one another to form a string of LEDs, wherein the LEDs of the first LED assembly 43*d* are of a first type, and the LEDs of the second LED assembly 44*d* are of a second type. The LED of the first type has a varying first luminous flux output as a function of its junction temperature, whereas the LED of the second type has a varying second luminous flux output as a function of its junction temperature, which function is different from the first luminous flux output of the LED of the first type as a function of its junction temperature.

Each one of the LEDs of the first LED assembly 43*d* is connected in parallel to a resistor assembly 46*a*, . . . , 46*b*, respectively, generally indicated with a dashed line. Thus, the (first) resistor assembly 46*a*, which in an embodiment may comprise a single resistor 47*a*, but may also comprise multiple resistors (a resistor network), has one end connected to input terminal 41*a*, and the (last) resistor assembly 46*b*, which in an embodiment may comprise a single resistor 47*b*, but may also comprise multiple resistors (a resistor network), has one end connected to the node 45.

Assuming that in the embodiments of the lighting device 42*a-d* as shown in FIGS. 4*a*, 4*b*, 4*c*, and 4*d*, the LEDs of the first LED assembly 43*a*, 43*b*, 43*c*, and 43*d*, respectively, have a luminous flux output which decreases with increasing junction temperature at a first rate, whereas the LEDs of the second LED assembly 44*a*, 44*b*, 44*c*, and 44*d*, respectively, have a luminous flux output which decreases with increasing junction temperature at a second rate which is lower than the first rate, the resistance of the resistor assembly 46, 46*a*, and 46*b*, respectively, is adapted to increase with increasing temperature of the resistor assembly 46, 46*a*, 46*b*, respectively, such as to stabilize, within a predetermined range, a ratio of the luminous flux output of the first LED assembly 43*a*, 43*b*, 43*c*, and 43*d*, respectively, to the luminous flux output of the second LED assembly 44*a*, 44*b*, 44*c*, and 44*d*, respectively, at different junction temperatures of the first LED assembly 43*a*, 43*b*, 43*c*, and 43*d*, respectively, and the second LED assembly 44*a*, 44*b*, 44*c*, and 44*d*, respectively. With rising junction temperatures of the first LED assembly 43*a*, 43*b*, 43*c*, and 43*d*, respectively, and the second LED assembly 44*a*, 44*b*, 44*c*, and 44*d*, respectively, also the temperature of the resistor assembly 46, 46*a*, and 46*b*, respectively, rises. As a consequence, the resistance of the resistor assembly 46, 46*a*, and 46*b*, respectively, increases, and relatively more current flows in the first LED assembly 43*a*, 43*b*, 43*c*, and 43*d*, respectively, leading to an increasing (in fact less decreasing than in case the resistor assembly would be absent) luminous flux output of the first LED assembly 43*a*, 43*b*, 43*c*, and 43*d*, respectively, whereas less current flows in the resistor assembly 46, 46*a*, and 46*b*, respectively, connected in parallel thereto, and whereas the current in the second LED assembly 44*a*, 44*b*, 44*c*, and 44*d*, respectively, remains constant.

Alternatively, assuming that in the embodiments of the lighting device 42*a-d* as shown in FIGS. 4*a*, 4*b*, 4*c*, and 4*d*, the LEDs of the first LED assembly 43*a*, 43*b*, 43*c*, and 43*d*, respectively, have a luminous flux output which decreases with increasing junction temperature at a first rate, whereas the LEDs of the second LED assembly 44*a*, 44*b*, 44*c*, and 44*d*, respectively, have a luminous flux output which decreases with increasing junction temperature at a second rate which is higher than the first rate, the resistance of the resistor assembly 46, 46*a*, . . . , 46*b*, respectively, is adapted to decrease with increasing temperature of the resistor assembly 46, 46*a*, . . . , 46*b*, respectively, such as to stabilize, within a predetermined range, a ratio of the luminous flux output of the first LED assembly 43*a*, 43*b*, 43*c*, and 43*d*, respectively, to the luminous flux output of the second LED assembly 44*a*, 44*b*, 44*c*, and 44*d*, respectively, at different junction temperatures of the first LED assembly and the second LED assembly. With rising junction temperatures of the first LED assembly 43*a*, 43*b*, 43*c*, and 43*d*, respectively, and the second LED assembly 44*a*, 44*b*, 44*c*, and 44*d*, respectively, also the temperature of the resistor assembly 46, 46*a*, and 46*b*, respectively, rises. In this case, as a consequence, the resistance of the resistor assembly 46, 46*a*, and 46*b*, respectively, decreases, and relatively less current flows in the first LED assembly 43*a*, 43*b*, 43*c*, and 43*d*, respectively, leading to a decreasing (in fact more decreasing than in case the resistor assembly would be absent) luminous flux output of the first LED assembly 43*a*, 43*b*, 43*c*, and 43*d*, respectively, whereas more current flows in the resistor assembly 46, 46*a*, and 46*b*, respectively, connected in parallel thereto, and whereas the current in the second LED assembly 44*a*, 44*b*, 44*c*, and 44*d*, respectively, remains constant.

Example of a LED types having first and second rates of luminous flux output decrease with increasing junction temperature, are AlInGaP type and InGaN type LEDs, respectively.

In a lighting device 42*a-d*, the LEDs may be mounted on a common heat sink to thermally couple the junctions of the first LED assembly and the second LED assembly. Similarly, the resistor assembly or assemblies in a lighting device are thermally coupled to the associated LED or LED assembly or part thereof, in particular to the junctions thereof, e.g. by being mounted on a common heat sink. Thus, the temperatures of the LED junctions and the resistor assembly or assemblies are essentially the same, or at least follow each other.

Figure 5A:
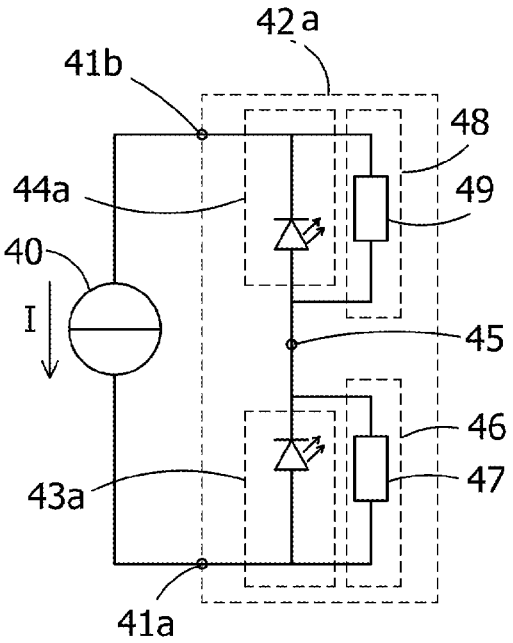
FIGS. 5*a*, 5*b*, 5*c*, and 5*d* depict further circuit diagrams of different embodiments of a LED lighting device according to the present invention.

Referring to FIG. 5*a*, the lighting device 42*a* comprises a first LED assembly 43*a*, indicated by dashed line, and a second LED assembly 44*a*, indicated by a dashed line, connected in series to the first LED assembly 43*a* through a node 45 connecting a cathode of the first LED assembly 43*a* with an anode of the second LED assembly 44*a*. The series connection of the first LED assembly 43*a* and the second LED assembly 44*a* is connected between the input terminals 41*a*, 41*b* of the LED lighting device 42*a*. Each of the first LED assembly 43*a* and the second LED assembly 44*a* comprises a single LED, wherein the LED of the first LED assembly 43*a* is of a first type, and the LED of the second LED assembly 44*a* is of a second type. The LED of the first type has a varying first luminous flux output as a function of its junction temperature, whereas the LED of the second type has a varying second luminous flux output as a function of its junction temperature, which function is different from the first luminous flux output of the LED of the first type as a function of its junction temperature.

The LED of the first type is connected in parallel to a resistor assembly 46 generally indicated with a dashed line.

Thus, the resistor assembly 46, which in an embodiment may comprise a single resistor 47, but may also comprise multiple resistors (a resistor network), is connected between input terminal 41 *a* and node 45.

The LED of the second type is connected in parallel to a resistor assembly 48 generally indicated with a dashed line. Thus, the resistor assembly 48, which in an embodiment may comprise a single resistor 49, but may also comprise multiple resistors (a resistor network), is connected between input terminal 41*b* and node 45.

Figure 5B:
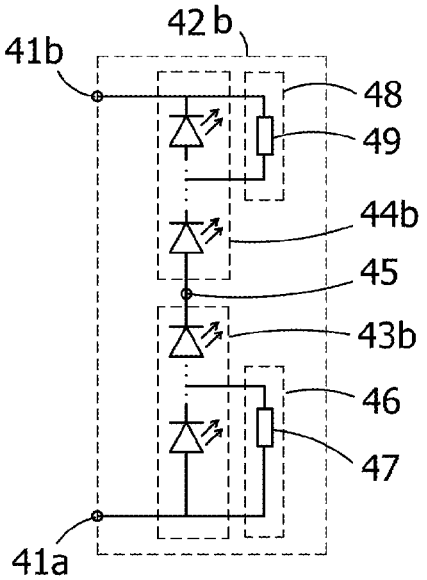

Referring to FIG. 5*b*, the lighting device 42*b* comprises a first LED assembly 43*b*, indicated by dashed line, and a second LED assembly 44*b*, indicated by a dashed line, connected in series to the first LED assembly 43*b* through a node 45 connecting a cathode of the first LED assembly 43*b* with an anode of the second LED assembly 44*b*. The series connection of the first LED assembly 43*b* and the second LED assembly 44*b* is connected between the input terminals 41*a*, 41*b* of the LED lighting device 42*b*. Each, or at least one of the first LED assembly 43*b* and the second LED assembly 44*b* comprises more than one LED connected in series to one another to form a string of LEDs, wherein the LEDs of the first LED assembly 43*b* are of a first type, and the LEDs of the second LED assembly 44*b* are of a second type. The LED of the first type has a varying first luminous flux output as a function of its junction temperature, whereas the LED of the second type has a varying second luminous flux output as a function of its junction temperature, which function is different from the first luminous flux output of the LED of the first type as a function of its junction temperature.

At least one of the LEDs of the first type is connected in parallel to a resistor assembly 46 generally indicated with a dashed line. Thus, the resistor assembly 46, which in an embodiment may comprise a single resistor 47, but may also comprise multiple resistors (a resistor network), is connected between, on the one hand, input terminal 41*a* and, on the other hand, a node between two subsequent LEDs of the string of LEDs of the first type. Alternatively, the resistor assembly 46 may be connected between, on the one hand, node 45 and, on the other hand, a node between two subsequent LEDs of the string of LEDs of the first type. As a further alternative, the resistor assembly 46 may be connected between, on the one hand, a node between two subsequent LEDs of the string of LEDs of the first type and, on the other hand, another node between two subsequent LEDs of the string of LEDs of the first type.

At least one of the LEDs of the second type is connected in parallel to a resistor assembly 48 generally indicated with a dashed line. Thus, the resistor assembly 48, which in an embodiment may comprise a single resistor 49, but may also comprise multiple resistors (a resistor network), is connected between, on the one hand, input terminal 41*b* and, on the other hand, a node between two subsequent LEDs of the string of LEDs of the second type. Alternatively, the resistor assembly 48 may be connected between, on the one hand, node 45 and, on the other hand, a node between two subsequent LEDs of the string of LEDs of the second type. As a further alternative, the resistor assembly 48 may be connected between, on the one hand, a node between two subsequent LEDs of the string of LEDs of the second type and, on the other hand, another node between two subsequent LEDs of the string of LEDs of the second type.

Figure 5C:
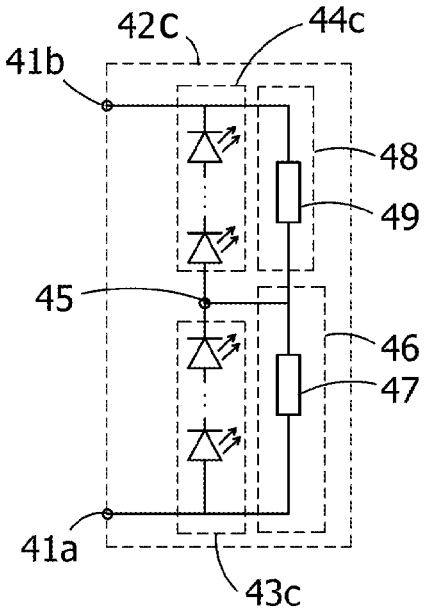

Referring to FIG. 5*c*, the lighting device 42*c* comprises a first LED assembly 43*c*, indicated by dashed line, and a second LED assembly 44*c*, indicated by a dashed line, connected in series to the first LED assembly 43*c* through a node 45 connecting a cathode of the first LED assembly 43*c* with an anode of the second LED assembly 44*c*. The series connection of the first LED assembly 43*c* and the second LED assembly 44*c* is connected between the input terminals 41*a*, 41*b* of the LED lighting device 42*c*. Each, or at least one of the first LED assembly 43*c* and the second LED assembly 44*c* comprises more than one LED connected in series to one another to form a string of LEDs, wherein the LEDs of the first LED assembly 43*c* are of a first type, and the LEDs of the second LED assembly 44*c* are of a second type. The LED of the first type has a varying first luminous flux output as a function of its junction temperature, whereas the LED of the second type has a varying second luminous flux output as a function of its junction temperature, which function is different from the first luminous flux output of the LED of the first type as a function of its junction temperature.

At least one of the LEDs of the first type is connected in parallel to a resistor assembly 46 generally indicated with a dashed line. Thus, the resistor assembly 46, which in an embodiment may comprise a single resistor 47, but may also comprise multiple resistors (a resistor network), is connected between input terminal 41*a* and node 45.

At least one of the LEDs of the second type is connected in parallel to a resistor assembly 48 generally indicated with a dashed line. Thus, the resistor assembly 48, which in an embodiment may comprise a single resistor 49, but may also comprise multiple resistors (a resistor network), is connected between input terminal 41*b* and node 45.

Figure 5D:
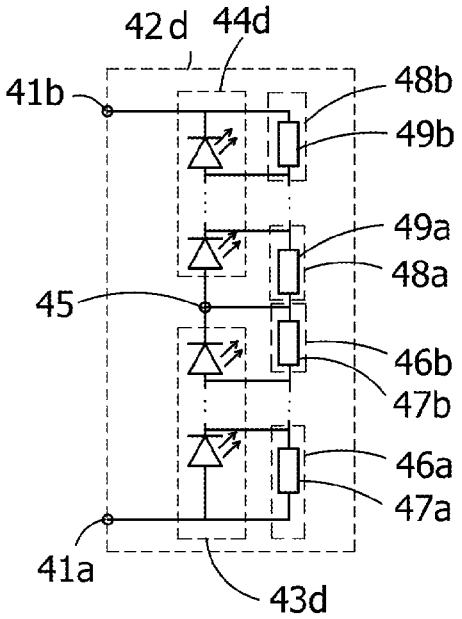

Referring to FIG. 5*d*, the lighting device 42*d* comprises a first LED assembly 43*d*, indicated by dashed line, and a second LED assembly 44*d*, indicated by a dashed line, connected in series to the first LED assembly 43*d* through a node 45 connecting a cathode of the first LED assembly 43*d* with an anode of the second LED assembly 44*d*. The series connection of the first LED assembly 43*d* and the second LED assembly 44*d* is connected between the input terminals 41*a*, 41*b* of the LED lighting device 42*d*. Each, or at least one of the first LED assembly 43*d* and the second LED assembly 44*d* comprises more than one LED connected in series to one another to form a string of LEDs, wherein the LEDs of the first LED assembly 43*d* are of a first type, and the LEDs of the second LED assembly 44*d* are of a second type. The LED of the first type has a varying first luminous flux output as a function of its junction temperature, whereas the LED of the second type has a varying second luminous flux output as a function of its junction temperature, which function is different from the first luminous flux output of the LED of the first type as a function of its junction temperature.

Each one of the LEDs of the first LED assembly 43*d* is connected in parallel to a resistor assembly 46*a*, . . . , 46*b*, respectively, generally indicated with a dashed line. Thus, the (first) resistor assembly 46*a*, which in an embodiment may comprise a single resistor 47*a*, but may also comprise multiple resistors (a resistor network), has one end connected to input terminal 41*a*, and the (last) resistor assembly 46*b*, which in an embodiment may comprise a single resistor 47*b*, but may also comprise multiple resistors (a resistor network), has one end connected to the node 45.

Each one of the LEDs of the second LED assembly 44*d* is connected in parallel to a resistor assembly 48*a*, . . . , 48*b*, respectively, generally indicated with a dashed line. Thus, the (first) resistor assembly 48*a*, which in an embodiment may comprise a single resistor 49*a*, but may also comprise multiple resistors (a resistor network), has one end connected to input terminal 41*b*, and the (last) resistor assembly 48*b*, which in an embodiment may comprise a single resistor 49*b*, but may also comprise multiple resistors (a resistor network), has one end connected to the node 45.

Assuming that in the embodiments of the lighting device 42*a-d* as shown in FIGS. 5*a*, 5*b*, 5*c*, and 5*d*, the LEDs of the first LED assembly 43*a*, 43*b*, 43*c*, and 43*d*, respectively, have a luminous flux output which decreases with increasing junction temperature at a first rate, whereas the LEDs of the second LED assembly 44*a*, 44*b*, 44*c*, and 44*d*, respectively, have a luminous flux output which decreases with increasing junction temperature at a second rate which is lower than the first rate, the resistance of the resistor assembly 46, 46*a*, . . . , 46*b*, respectively, is adapted to increase with increasing temperature of the resistor assembly 46, 46*a*, . . . , 46*b*, respectively, whereas the resistance of the resistor assembly 48, 48*a*, . . . , 48*b*, respectively, is adapted to decrease with increasing temperature of the resistor assembly 48, 48*a*, . . . , 48*b*, respectively, such as to stabilize, within a predetermined range, a ratio of the luminous flux output of the first LED assembly 43*a*, 43*b*, 43*c*, and 43*d*, respectively, to the luminous flux output of the second LED assembly 44*a*, 44*b*, 44*c*, and 44*d*, respectively, at different junction temperatures of the first LED assembly and the second LED assembly. With rising junction temperatures of the first LED assembly 43*a*, 43*b*, 43*c*, and 43*d*, respectively, and the second LED assembly 44*a*, 44*b*, 44*c*, and 44*d*, respectively, also the temperature of the resistor assembly 46, 46*a*, . . . , 46*b*, respectively, and the resistor assembly 48, 48*a*, . . . , 48*b* rises. As a consequence, the resistance of the resistor assembly 46, 46*a*, . . . , 46*b*, respectively, increases, and relatively more current flows in the first LED assembly 43*a*, 43*b*, 43*c*, and 43*d*, respectively, leading to an increasing (in fact less decreasing than in case the resistor assembly would be absent) luminous flux output of the first LED assembly 43*a*, 43*b*, 43*c*, and 43*d*, respectively, whereas less current flows in the resistor assembly 46, 46*a*, . . . , 46*b*, respectively, connected in parallel thereto. Also, the resistance of the resistor assembly 48, 48*a*, . . . , 48*b*, respectively, decreases, and relatively less current flows in the second LED assembly 44*a*, 44*b*, 44*c*, and 44*d*, respectively, leading to a decreasing (in fact more decreasing than in case the resistor assembly would be absent) luminous flux output of the second LED assembly 44*a*, 44*b*, 44*c*, and 44*d*, respectively, whereas more current flows in the resistor assembly 48, 48*a*, . . . , 48*b*, respectively, connected in parallel thereto.

As an example of a design method to determine a temperature dependency of a first resistor assembly and a second resistor assembly, such as the first resistor assembly 46 and the second resistor assembly 48 in the lighting device 42*c* depicted in FIG. 5*c*, the following guidelines bring the desired result.

Goal is to keep the luminous flux ratio between the first LED assembly 43*c* and the second LED assembly 44*c* constant. The luminous flux of each of the first LED assembly and the second LED assembly can be described with a nominal value and a temperature and current dependency:

$$\phi_i=\phi_{i,0}f_i(I_i,\Delta T_i)$$

where $\phi_i$ is the total luminous flux in the i-th LED assembly. The subscript 0 denotes the nominal values, $\Delta T_i=T_i-T_{i,0}$. The temperature $T_i$ refers to the (average) junction temperature of the LEDs in the i-th LED assembly. The function $f$ is a function that describes the behavior of the luminous flux of the LEDs of the i-th LED assembly as a function of temperature and current.

According to the present invention, the flux ratio between the average luminous flux output of the LEDs in the first and second LED assembly should be kept constant (C):

$$\frac{\phi_1}{\phi_2}=C$$

This yields an explicit relation of $I_1$ as a function of $I_2$ and $\Delta T$. Furthermore, for the total current $I_{tot}$ in each LED assembly, the following simple relations hold:

$$I_{tot}=I_1+I_{R,1}=I_2+I_{R,2}$$

By definition, the voltage over a LED assembly $V_{f,i}$ equals $I_{R,i}*R(\Delta T)_i$, where $V_{f,i}$ is the voltage over the i-th LED assembly and $R(\Delta T_{R,i})_i$ is the temperature dependent resistance of the circuit parallel to the i-th LED assembly, where $\Delta T_{R,i}$ is the temperature at the resistor assembly parallel to the i-th LED assembly.

In general, the temperatures are related via a correlation matrix of thermal resistances $R_{th}$:

$$\Delta T_1=\Delta T_{sin\ k}+R_{th,1,1}P_{LED,1}+R_{th,1,2}P_{LED,2}+R_{th,1,R1}P_{R,1}+R_{th,1,R2}P_{R,2}$$

$$\Delta T_2=\Delta T_{sin\ k}+R_{th,2,1}P_{LED,1}+R_{th,2,2}P_{LED,2}+R_{th,2,R1}P_{R,1}+R_{th,2,R2}P_{R,2}$$

$$\Delta T_{R1}=\Delta T_{sin\ k}+R_{th,R1,1}P_{LED,1}+R_{th,R1,2}P_{LED,2}+R_{th,R1,R1}P_{R,1}+R_{th,R1,R2}P_{R,2}$$

$$\Delta T_{R2}=\Delta T_{sin\ k}+R_{th,R2,1}P_{LED,1}+R_{th,R2,2}P_{LED,2}+R_{th,R2,R1}P_{R,1}+R_{th,R2,R2}P_{R,2}$$

where $P_{LED,i}$ is the dissipated heat of the i-th LED assembly and $P_{R,i}$ is the dissipated heat of the i-th resistor assembly. The values of the thermal resistances $R_{th}$ can all be determined in a test setup. The last equations are:

$$V_{f,i}=g_i(I_i,\Delta T_i)$$

$$V_{f,i}=R(\Delta T_{R,i})_i I_{R,i}$$

where $g_i$ is a function that describes a forward voltage of a LED as a function of current I and temperature T.

The last step is to define the current through one of the LED assemblies at a certain temperature and to define the total current. The total system of equations can be solved by iteration. A unique solution is found if the temperature behavior of one the resistor assemblies is set.

As explained above, according to the present invention a lighting device has a plurality of LEDs connected in series. In the lighting device, a first LED assembly has LEDs of a first type having a first luminous flux output decreasing as a first function of its junction temperature. A second LED assembly has LEDs of a second type having a second luminous flux output decreasing as a second function of its junction temperature different from the first function. At least one of the LEDs of the first type and LEDs of the second type is connected in parallel to a resistor assembly having a temperature-dependent resistance. The temperature dependence of the resistance stabilizes a ratio of the first luminous flux output to the second luminous flux output at different junction temperatures of the first LED assembly and the second LED assembly.

The lighting device of the present invention has been illustrated by referring to LED assemblies of two different types. However, the lighting device may further comprise one or more of any other type of LED different from the first type and the second type.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The invention claimed is:

1. A lighting device comprising a plurality of light emitting diodes, LEDs, the lighting device comprising:

a first LED assembly comprising at least one LED of a first type having a varying first luminous flux output as a function of its junction temperature;

a second LED assembly comprising at least one LED of a second type having a varying second luminous flux output as a function of its junction temperature different from the first luminous flux output of the first LED assembly as a function of its junction temperature, wherein the first LED assembly is connected in series to the second LED assembly, and wherein at least one of the LEDs of the first type and LEDs of the second type is connected in parallel to a resistor assembly having a temperature dependent resistance, the temperature dependence of the resistance being adapted to increase a stabilization of, within a predetermined range, a ratio of the first luminous flux output to the second luminous flux output at different junction temperatures of the first LED assembly and the second LED assembly.

2. The lighting device of claim 1, wherein the first luminous flux output decreases with increasing junction temperature of the first LED assembly at a first rate, and the second luminous flux output decreases with increasing junction temperature of the second LED assembly at a second rate lower than the first rate, a first resistor assembly being connected in parallel to at least one LED of the first LED assembly, and a second resistor assembly being connected in parallel to at least one LED of the second LED assembly, the resistance of the first resistor assembly increasing with increasing temperature of the first resistor assembly, and the resistance of the second resistor assembly decreasing with increasing temperature of the second resistor assembly.

3. The lighting device in claim 1, wherein the LED of the first type is adapted to produce light having a first color, and wherein the LED of the second type is adapted to produce light having a second color different from the first color.

4. The lighting device in claim 1, wherein the resistor assembly and the at least one of the LEDs of the first type and the LEDs of the second type connected in parallel thereto are thermally coupled.

5. The lighting device in claim 1, wherein the junctions of the first LED assembly and the second LED assembly are thermally coupled.

6. The lighting device in claim 1, wherein the LED of the first type is an AlInGaP type LED.

7. The lighting device in claim 1, wherein the LED of the second type is an InGaN type LED.

8. A lighting system, comprising:

a dimmer having input terminals adapted to be connected to an electrical power supply, the dimmer having output terminals adapted to provide a variable current; and a lighting device according to claim 1, the lighting device having terminals configured to be connected to the output terminals of the dimmer.

9. The lighting device of claim 1, wherein the first luminous flux output decreases with increasing junction temperature of the first LED assembly at a first rate, and the second luminous flux output decreases with increasing junction temperature of the second LED assembly at a second rate lower than the first rate, a first resistor assembly being connected in parallel to at least one LED of the first LED assembly, and the resistance of the first resistor assembly increasing with increasing temperature of the first resistor assembly.

10. The lighting device of claim 9, wherein the first resistor assembly comprises a positive temperature coefficient, PTC, resistor.

11. The lighting device of claim 1, wherein the first luminous flux output decreases with increasing junction temperature of the first LED assembly at a first rate, and the second luminous flux output decreases with increasing junction temperature of the second LED assembly at a second rate lower than the first rate, a second resistor assembly being connected in parallel to at least one LED of the second LED assembly, and the resistance of the second resistor assembly decreasing with increasing temperature of the second resistor assembly.

12. The lighting device of claim 11, wherein the second resistor assembly comprises a negative temperature coefficient, NTC, resistor.

13. A method of producing a lighting device comprising a plurality of light emitting diodes, LEDs, the method comprising:

providing a first LED assembly comprising at least one LED of a first type having a varying first luminous flux output as a function of its junction temperature;

providing a second LED assembly comprising at least one LED of a second type having a varying second luminous flux output as a function of its junction temperature different from the first luminous flux output of the first LED assembly as a function of its junction temperature;

connecting the first LED assembly in series to the second LED assembly;

connecting at least one of the LEDs of the first type and the LEDs of the second type in parallel to a resistor assembly having a temperature-dependent resistance; and adapting the temperature dependence of the resistance to increase a stabilization of, within a predetermined range, a ratio of the first luminous flux output to the second luminous flux output at different junction temperatures of the first LED assembly and the second LED assembly.

* * * * *